United States Patent [19]

Queneau et al.

[11] 4,337,086

[45] Jun. 29, 1982

[54] METHOD FOR DECREASING METAL LOSSES IN NONFERROUS SMELTING OPERATIONS

[76] Inventors: Paul E. Queneau, Cornish, N.H. 03746; Reinhardt Schuhmann, Jr., 1206 Hayes St., West LaFayette, Ind. 47906

[21] Appl. No.: 197,563

[22] Filed: Oct. 16, 1980

Related U.S. Application Data

[63] Continuation-in-part of Ser. No. 971,995, Dec. 21, 1978, Pat. No. 4,236,915.

[51] Int. Cl.[3] ..... C22B 15/00; C22B 23/02

[52] U.S. Cl. ..... 75/69; 75/23; 75/25; 75/62; 75/70; 75/71; 75/74; 75/77; 75/81; 75/82; 75/85; 75/88; 75/92

[58] Field of Search ..... 75/23, 92, 74, 82, 62, 75/69, 70, 71, 77, 81, 85, 88, 84, 25; 266/182

[56] References Cited

U.S. PATENT DOCUMENTS 3,533,779 10/1970 Fine et al. ..... 75/74
3,674,463 7/1972 Yannopoulos ..... 75/74
4,036,636 7/1977 Ammann et al. ..... 75/82
4,147,535 4/1979 Lilja et al. ..... 266/182
4,217,132 8/1980 Burge et al. ..... 75/72

*Primary Examiner*—M. J. Andrews
*Attorney, Agent, or Firm*—Parmelee, Miller, Welsh & Kratz

[57] ABSTRACT

A process for producing a metal matte from a nonferrous metal-containing sulfide mineral concentrate in a horizontally disposed furnace wherein small sulfide particles are separated from the concentrate, compacted and introduced into the furnace along with the remainder of the concentrate; a melted iron sulfide-rich concentrate is spread onto the slag adjacent the introduction of the sulfide mineral concentrate; and a metallic iron-rich material containing carbon or silicon is spread onto the slag at a location adjacent the introduction of the melted iron sulfide-rich concentrate but spaced from the slag discharge of the furnace, such that a high-grade nonferrous metal matte is produced and the loss of nonferrous metals is averted.

27 Claims, 1 Drawing Figure

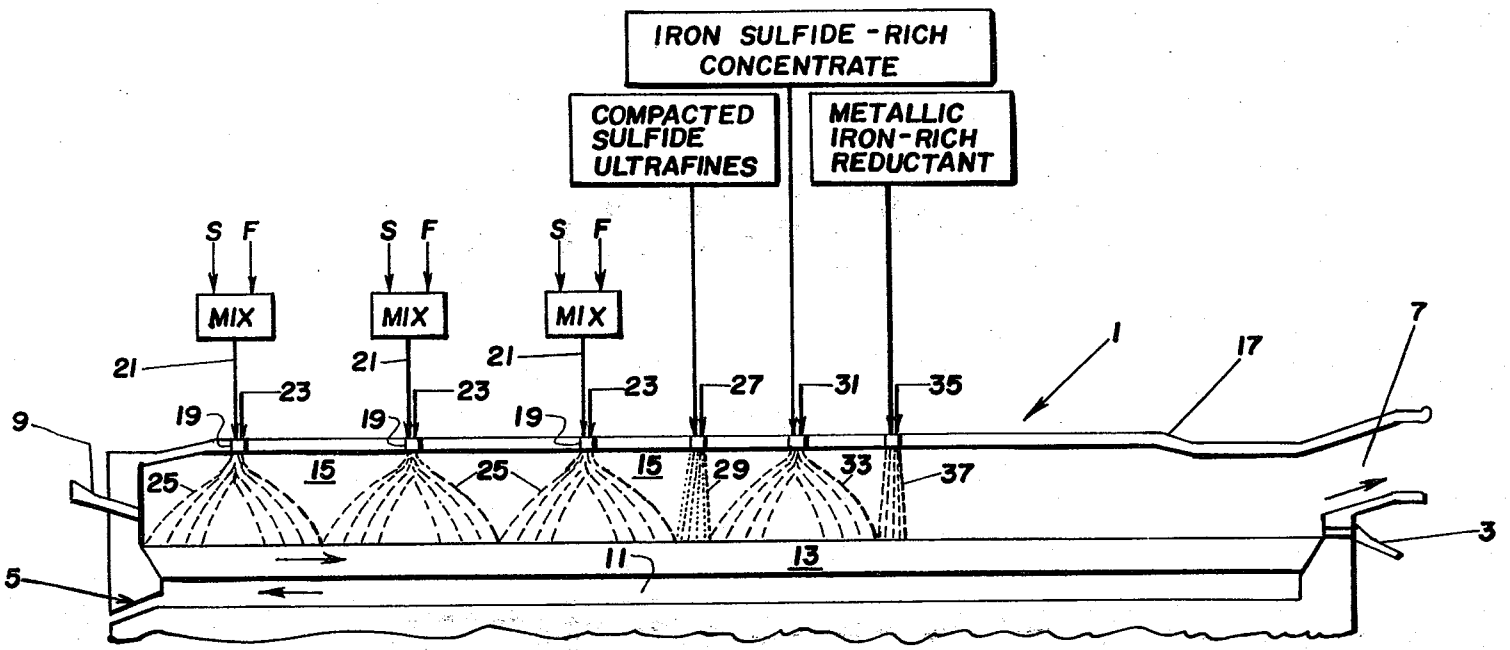
IRON SULFIDE - RICH CONCENTRATE
COMPACTED SULFIDE ULTRAFINES
METALLIC IRON-RICH REDUCTANT
S F
MIX
S F
MIX
S F
MIX
1
3
5
7
9
11
13
15
15
17
19
19
19
21
21
21
23
23
23
25
25
27
29
31
33
35
37

METHOD FOR DECREASING METAL LOSSES IN NONFERROUS SMELTING OPERATIONS

CROSS REFERENCE TO RELATED APPLICATION

This application is a continuation-in-part of copending application of the present inventors, Ser. No. 971,995 filed Dec. 21, 1978, entitled "Process for Oxygen Sprinkle Smelting of Sulfide Concentrates now U.S. Pat. No. 4,236,915.

BACKGROUND OF THE INVENTION

A number of new processes for smelting copper and nickel sulfide concentrates have been adopted on a commercial scale during the past thirty years. Well-known examples of such are the Inco, Mitsubishi, Noranda and Outokumpu processes. Detailed descriptions of these innovations are provided in the patent and technical literature, e.g., *Extractive Metallurgy of Copper,* Metallurgical Society A.I.M.E., 1976, Vol. 1. Despite the variety of their advantages they all suffer from the important value element content of their furnace slags and the high content of troublesome ultrafine concentrate particulate matter mechanically entrained in their furnace exhaust gases. Furthermore, in addition to copper, nickel, cobalt and the toxic, ubiquitous element, arsenic, valuable, volatile metal and metalloid minor elements are often exhausted in said gases, e.g., antimony, bismuth, cadmium, germanium, indium, lead, mercury, molybdenum, osmium, rhenium, selenium, tellurium, tin and zinc. The furnace matte also contains these impurity elements but a large fraction thereof is conventionally returned to the furnace in converter slag or in converter electrostatic precipitator dust. These elements are present in the furnace slag either in solution as a homogenous mixture or as a heterogenous mixture of disseminated matte entities suspended in the slag matrix. An external slag scavenging procedure, e.g., slag flotation or electric furnace treatment, is frequently employed to decrease loss of values in the furnace slag; and an external dust recovery system, e.g., electrostatic precipitator, bag house, or wet scrubber, is conventionally employed to decrease loss of values in the furnace exhaust gas. Such installations are, furthermore, necessary to prevent escape of toxic elements, e.g., arsenic, cadmium, lead, and mercury, to the environment. It should also be noted that the exhaust gas dust content can be troublesome in the steam boilers usually employed to recover heat from said gas.

It is well known, of course, that conventional copper and nickel reverberatory furnaces suffer seriously from the extravagant cost of their fossil fuel requirements, the undesirably low sulfur dioxide content of the voluminous and dusty furnace gas, the undesirably low value metal concentration of the furnace matte, and the extravagant value metal content of the furnace slag.

The prior art discloses internal furnace slag scavenging procedures for decreasing copper, nickel and cobalt losses in slag by subjecting it to reducing reactions so as to decrease its oxygen potential. Reference is made to the use of iron sulfide, carbon and iron reductants as described by H. H. Stout in U.S. Pat. No. 1,544,048 and by Anton Gronningsaeter in U.S. Pat. No. 2,438,911. However, past attempts to apply concepts of this nature on a commercial scale in the primary furnace have not proven sufficiently rewarding, e.g., the procedure described by one of the present applicants in U.S. Pat. No. 2,668,107.

It is an object of the present invention to improve smelting practice by substantially decreasing the amount of value elements transported out of the furnace by the slag. A further object of the present invention is to improve smelting practice by substantially decreasing the amount of troublesome ultrafine concentrate particulate matter transported out of the furnace by the exhaust gas. An additional object of this invention is to improve smelting practice by decreasing the net cost of effective emission control of particulates, vapors, and sulfur oxides in said gas through maximizing extraction, by vaporization from the concentrate of volatile impurities, thus increasing the concentration of said impurities in the particulates collected and by increasing the concentration of sulfur dioxide in said gas.

BRIEF SUMMARY OF THE INVENTION

The need for external slag scavenging procedures to decrease value losses is averted by use of an oxygen sprinkle smelting furnace in which the oxygen potential of the slag produced by several main feed concentrate burners is decreased by its series treatment with increasingly strong reductants. These burners operate at elevated temperature and produce matte of high oxygen potential. Many of the elements listed above are volatilized, leave the furnace as vapor or fume in the exhaust gas, and therefore a major portion thereof is not trapped in either furnace slag or matte.

Said increasingly strong reductants can be melted main feed concentrate ultrafines followed by melted iron sulfide-rich concentrates followed finally be a metallic iron-rich material.

Said ultrafines are preferably less than about 5 microns in diameter; they consist of the finest fraction of the main feed concentrate and can be segregated readily in the course of drying it. This material can be distributed over the slag in the form of briquettes or indurated pellets, or in liquid form after melting it in any suitable burner using fossil fuel and oxygen-rich gas. The slag is then sprinkled with iron-rich sulfide concentrate which has been melted by an oxygen sprinkler burner using coal. The final reducing operation, e.g., for major increase in cobalt recovery, can be effected by spraying metallic iron-rich particulate matter on the said slag, normally containing at least one of the elements of the group comprising carbon and silicon.

The main feed burners are operated at elevated flame temperatures, under conditions of superior interface contact and mixing, and produce finely divided matte of high surface area and of high oxygen potential. The sulfides of many of the elements listed above are readily volatilized as sulfides, metal, or oxide vapors or fumes, and consequently report as such in the gas exhausted from the furnace and, therefore, do not get trapped in furnace slag or matte.

Exhaust gas particulates, e.g. containing copper, nickel or cobalt, and fumes or condensed vapors, e.g. containing arsenic, bismuth, cadmium, lead, molybdenum, or zinc, are collected and extracted hydrometallurgically; and their copper, nickel, and cobalt content can be returned to the smelting furnace, if desired.

BRIEF DESCRIPTION OF THE DRAWING

The drawing is a schematic illustration of a cross-section of a horizontally furnace useful in the present process showing the preferred locations for injecting the several solid and gaseous feeds and for discharging the several products, the slag and matte being in countercurrent flow and the slag and gas in concurrent flow.

DETAILED DESCRIPTION

The present process is an improved method for flash smelting of nonferrous metal-containing mineral sulfides in a horizontal furnace which substantially decreases loss of value elements in furnace products. A particular flash smelting method to which the present improved process may be applied is the method described in our copending application Ser. No. 971,995 filed Dec. 21, 1978 now U.S. Pat. No. 4,236,915, entitled "Process for Oxygen Sprinkle Smelting of Sulfide Concentrates," the contents of said application being incorporated by reference herein.

The present process is particularly useful in the conversion of copper, nickel and cobaltiferous sulfide concentrates, e.g., concentrates rich in minerals such as bornite, chalcocite, chalcopyrite, carrollite, pentlandite, linnaeite, pyrite or pyrrhotite, to high grade matte, clean slag and clean waste gas.

Concentrates containing minerals in this group are introduced, along with flux material and oxygen-rich gas, into a hot enclosed sulfur dioxide-rich atmosphere in a horizontal furnace containing a molten matte layer on which floats a slag layer, said layers being discharged at opposite ends of said furnace. These sulfide concentrates are introduced into the enclosed hot sulfur dioxide-rich atmosphere by means of oxygen sprinkler burners and mix and react effectively with the oxygen-rich gas due to its large interface area at high temperatures with the sulfide concentrates prior to contact of said concentrates with the molten slag contained in the horizontal furnace. The term "oxygen-rich gas" is used herein to define gases which contain 33% or more oxygen, up to and including tonnage oxygen which contains about 80–99.5% oxygen content.

Very fast temperature rise within its paraboloid is achieved by the sprinkler burner because of its especially fine dispersion of feed metal sulfide particulates in the carrier oxygen-rich gas. The resulting extremely large reactant interface area takes maximum advantage of the high rate of the exothermic chemical reaction between ferrous sulfide and oxygen for the formation of ferrous oxide and sulfur dioxide. Furthermore, any boundary layer resistance to mass transfer in this reaction is minimized by the mixing and scrubbing action imparted to the system at exit from the sprinkler burner. Thus, flame temperature in the upper portion of the paraboloid exceeds 1450° C. As a consequence, the feed sulfide mineral particles are almost instantaneously converted to discrete liquid droplets at temperatures so elevated as to vaporize the major portion of contained elements having unusually high vapor pressures in their elemental, sulfide, or oxide states.

These elements include, specifically, arsenic, bismuth, cadmium, lead, molybdenum, and zinc, or their compounds. When present in the sulfide concentrate in minor but important quantities, over 75% of these volatiles will report as vapors or fumes in furnace exhaust gas, whence they can be recovered by conventional means, e.g. collected by electrostatic precipitators and wet scrubbers, and isolated by hydrometallurgical extraction. In this manner, their dissolution in, or reaction with the ferrous silicate or metal sulfide phases of the furnace bath is minimized, which may be most advantageous due to the difficulty or cost of their subsequent removal and isolation, e.g. from a subsequent metallic phase.

In the lower portion of the paraboloid the system has lost most of its radial velocity so that the well mixed particulate matter descends relatively slowly to the slag surface. Elapsed time in this portion is about an order of magnitude greater than in the upper portion, sufficient so that excellent heat transfer between the gas-liquid-solid phases of the dispersoid is effected. In addition to providing further time for impurity volatilization, the ferrous oxide-rich and silica-rich particles rain gently down on the slag surface at temperatures exceeding 1300° C., collide intimately thereon, and react efficiently in the bath for desired rapid production of ferrous silicate. Ferric oxide-rich and ferrous sulfide-rich particulates react likewise for desired efficient reduction of magnetite to ferrous oxide, with concomitant oxidation of ferrous sulfide to ferrous oxide and sulfur dioxide. The overall effect of this process is to ensure that furnace slag approaches equilibrium with the matte draining therethrough and has high fluidity for superior slag-matte separation. It should be noted that succeeding paraboloids in the furnace gas stream act as spray scrubbers for previously gas-borne fine particulates moving downstream.

The nonferrous metal-containing concentrates are introduced in a dry, finely divided state, preferably uniformly mixed with flux, and are preferably of a particle size less than about 65 mesh to provide for rapid reaction of the sulfide particles with oxygen in the gaseous phase above the molten slag within the furnace prior to contact of the particles with said molten slag, and thereafter from rapid reaction of the metal oxides so produced with ferrous sulfide and flux.

A typical such nonferrous metal-containing concentrate may contain about 10 percent by weight of particles of a size less than about 5 microns, the value metal analysis of which may be of the same general order as that of the total concentrate. This semi-colloidal dust is readily transported out of the furnace in the exhaust gas before it can settle onto the molten bath. Some of it accumulates in the flues or builds accretions in waste heat boilers, while the remainder burdens the dust recovery units and dilutes the concentration of impurity elements in the recovered dust.

According to the present process, the nonferrous metal-containing sulfide concentrates, of a particle size less than about 5 microns, may be separated from the remainder of the concentrates incidental to water removal, e.g. by fluid bed drying, and this fine particle size material is treated to compact the same. The ultrafine material, of −5 micron size, can be compacted by liquefaction and can be injected into the furnace in the molten state by melting it in any suitable burner using fossil fuel and oxygen-rich gas as the main heat source. An example of a suitable burner in the furnace sidewall is of the cyclone type with its long axis inclined downward at a substantial angle from the horizontal, e.g. 30°. Alternatively, the particles may be compacted by agglomeration, preferably by forming indurated pellets of a size in the range of about 1 mm to 10 mm in diameter. In the making of these agglomerates, there may also be incorporated other materials such as residues or other products from the hydrometallurgical treatment noted above.

These compacts, either molten material or agglomerates, are injected into the horizontal furnace through the roof or sidewalls and onto the slag at a location preferably just downstream from the last main concentrate sprinkler burner paraboloid suspension.

In the present invention, the slag formed during flash smelting of nonferrous metal-containing sulfide concentrates is cleaned by decreasing the oxygen potential of the slag through the series addition thereto of increasingly strong reductant material, i.e., its magnetite content is progressively reduced to a satisfactorily low level such as about 5%, by weight, or less. For this purpose, it is highly advantageous to have the matte and slag in countercurrent flow and the slag and gas in concurrent flow.

An important feature of the present invention is the ability to maintain high slag temperature with resulting low slag viscosity.

The first of the series of reductants added is the moderate grade matte resulting from the melting of the compacted ultrafine concentrate particles, the compacted particles being introduced into the furnace and onto the slag at a position adjacent the last paraboloidal suspension and spaced from the slag discharge end of the furnace.

The second of the series of reductants added is a low grade concentrate, low in nonferrous metal content and rich in iron sulfide content, which effects slag cleaning by the combined chemical, dilution and coalescing washing effects resulting from sprinkling a liquid matte rich in iron sulfide and poor in nonferrous metal content over the slag, drenching it therewith. An example of such material is a chalcopyrite-pyrite middling concentrate which may contain 4% copper, by weight, or a pyrite concentrate which may contain 0.5% copper, by weight. Another example is a pentlanditepyrrhotite middling concentrate which may contain 2% nickel by weight or a pyrrhotite concentrate which may contain 0.6% nickel, by weight. An important chemical effect of the iron sulfide is reduction of the magnetite and ferric iron content of the slag to ferrous oxide, concomitantly transforming dissolved nonferrous metal oxides to sulfides for their entry into the matte. The reduction of the magnetite is accompanied by an important decrease in slag viscosity and therefore more rapid and complete settling of suspended matte. There is an additional beneficial mixing action caused by $SO_2$ ebullition resulting from the chemical reaction. The present embodiment of the invention then further increases the furnace value metal recovery by decreasing the oxygen potential of the slag beyond that obtainable by use of iron sulfide addition alone. This is achieved in the last of the series reductant additions. Such practice can triple the cobalt recovery obtained in nickel reverberatory furnace operation. The relatively small amount of reductant spread over the slag in the last case, e.g. 2 percent, by weight, of the slag, is rich in metallic iron, and normally contains at least one element selected from the group comprising carbon and silicon, e.g., pig iron, silvery pig iron, ferrosilicon, sponge iron or scrap iron, such as gray iron boring chips. Low grade, high carbon, high sulfur sponge iron is a satisfactory reductant which can be readily and economically produced from pyrrhotite concentrate or middling, now stockpiled by the nickel industry. Carbon alone, as is known, can be used as a reductant, but its efficiency is usually poor due to its low specific gravity, which causes it to float on the slag, and its top injection into the slag, e.g., by roof lances, can cause operating difficulties. This last of the series of reductant additions is effected by spreading the same over the slag at a position spaced from the slag discharge end of the horizontal furnace sufficiently remote from the tap holes to provide adequate settling time for the new matte formed.

As an example of the major benefits conferred by the present invention over prior nonferrous smelting furnace practice, a chalcopyrite concentrate analyzing 25% Cu, 28% Fe, 31% S, and 8% $SiO_2$, and a minor but important amount of arsenic, bismuth, cadmium, lead, molybdenum, and zinc, totaling less than 2% by weight of the concentrate, is separated into approximately plus and minus 5 micron fractions by air elutriation in the course of fluid bed drying. The thus segregated ultrafines, having a weight of 7% of the total concentrate and a chemical analysis similar thereto are compacted by melting using a furnace burner employing oxygen and fossil fuel, and the resulting matte is spread over the slag at a location adjacent the last paraboloidal suspension of a system of three such paraboloidal suspensions. The balance of the concentrate is oxygen sprinkle smelted to a high grade matte employing commercial oxygen and three sprinkler burners. A major portion of the minor element impurities, e.g., arsenic, bismuth, cadmium, lead, molybdenum, and zinc, is vaporized because of the paraboloid flame conditions of excellent interface contact and mixing at high temperatures, exceeding 1450° C., and high oxygen potential, corresponding to a matte grade exceeding 65% copper, in the paraboloids. The furnace gas, analyzing over 20% $SO_2$ by volume, is exhausted from the furnace continuously, and contains over 75% of the arsenic, bismuth, cadmium, lead, molybdenum, zinc and sulfur content, respectively, in the overall sulfide feed. A slag cleaning reductant, introduced adjacent the means for introduction of the liquefied ultrafine material, remote from the slag discharge for adequate matte settling purposes, comprises a chalcopyritepyrite middling analyzing 4% Cu, 40% Fe and 45% S is melted and sprinkled over the slag. The high grade matte produced analyzes 65% Cu, 10% Fe and 22% S, while the final slag analyzes 0.4% Cu, for a recovery of over 98% of the copper.

As a further example of the present method, a pentlandite concentrate analyzing 12% Ni, 0.4% Co, 38% Fe, 31% S and 8% $SiO_2$ and a minor but important amount of cadmium, lead, and zinc, totaling less than 1%, by weight, of the concentrate, is separated into approximately plus and minus 5 micron fractions by air elutriation in the course of fluid bed drying. The separated −5 micron particulate material, having a weight of 7% of the total concentrate and a chemical analysis similar thereto, is compacted as 1–10 mm indurated pellets which are injected into the furnace and spread over the slag at a location adjacent the last paraboloidal suspension of concentrates. The remainder of the concentrate is oxygen sprinkle smelted to a high grade matte employing commercial oxygen and a plurality of oxygen sprinkle burners. Under the resulting conditions of high temperatures, exceeding 1450° C., and high oxygen potential in the paraboloids corresponding to a matte grade exceeding 55% Ni, the major portion of the minor element impurities, cadmium, lead and zinc present in the concentrate leave the furnace in the exhaust gas as vapor or fumes. This gas, analyzing over 20% $SO_2$ by volume, is exhausted from the furnace continuously, with over 75% of the cadmium, lead sulfur and zinc content of the overall sulfide feed. An iron sulfide-rich slag cleaning reductant, comprising pentlanditepyrrhotite middling analyzing 2% Ni, 56% Fe and 34% S, is melted and sprinkled over the slag by means of an oxygen sprinkler burner employing fossil fuel as a heat source, adjacent the introduction means for the compacted ultrafines and remote from the slag discharge for adequate matte settling purposes. The final reductant of the series of reductant additions, comprising granulated pig iron containing 4.5% C and 1.5% Si, is introduced sequentially into the furnace adjacent the last named molten addition and adequately spaced from the slag discharge of the furnace. The high-grade matte produced analyzes 55% Ni, 1.55% Co, 10% Fe and 26% S, while the final slag analyzes 0.15% Ni and 0.07% Co, for a recovery of about 99% and 83% of the nickel and cobalt, respectively.

The figure schematically illustrates locations of the injection ports for injection of the ultrafine concentrate, in agglomerated or liquid form, of the iron sulfide-rich concentrate in liquid form and of the iron-rich reductant material according to the present process where oxygen sprinkle smelting of concentrates is effected. The horizontal furnace 1, has a slag outlet 3, a matte outlet 5, and an exhaust gas outlet 7. A charging means 9 is present for return of converter slag. A molten matte 11 is present in the lower portion of the furnace with a layer of molten slag 13 thereover. A heated sulfur dioxide-rich atmosphere is enclosed in area 15 between the slag layer 13 and the roof of the furnace. Three oxygen sprinkler burners 19 are provided to generate suspensions of sulfide concentrate S and oxygen-rich gas, and preferably flux F, in the heated atmosphere of the furnace. Mixtures of sulfide concentrate and flux are charged through lines 21 to burners 19. Oxygen-rich gas is fed through lines 23 to form paraboloidal suspensions 25 within the hot atmosphere in the area 15 of the furnace. There is provided an injection means 27 adjacent the final paraboloid 25 and spaced from the slag discharge 3 for injection of the compacted ultrafine particulate nonferrous metal mineral concentrates 29, in agglomerated or molten form, into the furnace and onto the slag layer 13. Also provided is an injection means 31, adjacent means 27 and spaced from slag discharge 3, for sprinkling of a low grade concentrate 33 high in iron sulfide content and low in nonferrous metal content, into the furnace and onto the slag layer 13. There is also provided an injection means 35, spaced from the slag discharge end 3 of the furnace and sufficiently remote from the tap hole 5, for injection of the metallic iron-rich material 37 into the furnace and onto the slag layer 13.

As will be understood by those skilled in the art, some embodiments of this invention can be employed to improve other flash smelting or continuous processes; however, its application to the oxygen sprinkle smelting process and apparatus is particularly advantageous because its heat and mass transfer and distribution are favorable, and because the required reverberatory furnace modifications are relatively simple and inexpensive.

We claim:

1. In a method for producing a metal matte from a nonferrous metal-containing sulfide mineral concentrate, of a particle size of less than about 65 mesh and containing particles of a size less than about 5 microns, in a horizontally disposed furnace wherein a molten charge of metal matte and a slag are present, beneath an enclosed hot atmosphere, and exhaust gases, metal matte and slag are separately discharged therefrom, the improvement where loss of nonferrous metals is averted, comprising:

(a) separating said nonferrous metal-containing sulfide mineral concentrate particles thereof having a size less than about 5 microns from the remainder of said sulfide concentrate;

(b) compacting said separated concentrate particles to form compacted concentrate for introduction into said furnace and onto said slag; and (c) introducing the remainder of said sulfide concentrate, flux and an oxygen-rich gas into an enclosed hot sulfur dioxide-rich atmosphere so as to effect flash oxidation of the sulfide concentrates therein prior to contact of said concentrates with the molten slag, while injecting said compacted concentrate into the horizontal furnace and onto said slag at a location spaced from the slag discharge of the furnace.

2. In the method for producing a metal matte as defined in claim 1, the improvement wherein said nonferrous metal is selected from the group comprising copper, nickel, cobalt and mixtures thereof.

3. In the method for producing a metal matte as defined in claim 1, the improvement wherein said separated concentrate particles are compacted by separately melting the same and introducing the same in a molten state into the furnace and onto the slag.

4. In the method for producing a metal matte as defined in claim 1, the improvement wherein said separated concentrate particles are compacted by agglomerating said separated particles to form agglomerates of a size of between about 1 mm to 10 mm in diameter.

5. In the method for producing a metal matte as defined in claims 1 or 2, the improvement wherein the remainder of said sulfide concentrate and oxygen-rich gas is sprinkled into said enclosed hot sulfur-dioxide rich atmosphere, a major portion of said sulfide concentrate and oxygen-rich gas being injected as a mixture through a plurality of vertically disposed burners on said furnace into said enclosed sulfur dioxide-rich hot atmosphere as a plurality of paraboloidal suspensions, so as to effect substantially uniform heat and mass distribution over a major portion of said horizontal furnace.

6. In a method for producing a metal matte from a non-ferrous metal-containing sulfide mineral concentrate in a horizontally disposed furnace wherein a molten charge of metal matte and slag are present, beneath an enclosed hot atmosphere, and exhaust gases, metal matte and slag are separately discharged therefrom, the improvement wherein loss of nonferrous metals is averted comprising:

(a) introducing said sulfide concentrate, flux and an oxygen-rich gas into an enclosed hot sulfur dioxide-rich atmosphere so as to effect flash oxidation of the sulfide concentrate therein prior to contact of said concentrate with the molten slag; and (b) sprinkling melted iron sulfide-rich sulfide concentrate into the furnace by means of a burner, using fossil fuel and oxygen-rich gas as the main heat source therefor, to spread the same onto the slag, at a location adjacent and downstream from the introduction of said sulfide mineral concentrate, flux and oxygen-rich gas and spaced from the discharge for said slag.

7. In a method for producing a metal matte as defined in claim 6, the improvement wherein the major said nonferrous metal is copper.

8. In a method for producing a metal matte as defined in claim 6, the improvement wherein the major said nonferrous metal is nickel.

9. In a method for producing a metal matte as defined in claim 6, the improvement wherein the major nonferrous metals are copper and cobalt.

10. In a method for producing a metal matte as defined in claim 6, the improvement wherein said metal matte and slag flow countercurrently in said furnace.

11. In the method for producing a metal matte as defined in claim 6, the improvement wherein said sulfide concentrate and oxygen-rich gas is sprinkled into said enclosed hot sulfur dioxide-rich atmosphere, a major portion of said sulfide concentrate and oxygen-rich gas being injected as a mixture through a plurality of vertically disposed burners on said furnace into said enclosed sulfur dioxide-rich hot atmosphere as a plurality of paraboloidal suspensions, so as to effect substantially uniform heat and mass distribution over a major portion of said horizontal furnace.

12. In a method for producing a metal matte from a nonferrous metal-containing sulfide mineral concentrate in a horizontally disposed furnace wherein a molten charge of metal matte and a slag are present, beneath an enclosed hot atmosphere, and exhaust gases, metal matte and slag are separately discharged therefrom, the improvement wherein loss of nonferrous metals is averted comprising:

(a) introducing said sulfide concentrate, flux and an oxygen-rich gas into an enclosed hot sulfur dioxide-rich atmosphere so as to effect flash oxidation of the sulfide concentrate therein prior to contact of said concentrate with the molten slag;

(b) sprinkling a melted iron sulfide-rich sulfide concentrate into the furnace by means of a burner, using fossil fuel and oxygen-rich gas as the main heat source therefor, to spread the same onto the slag, at a location adjacent and downstream from the introduction of said sulfide mineral concentrate, flux and oxygen-rich gas and spaced from the discharge for said slag; and (c) injecting a reductant material into the furnace, for spreading over the slag at a location adjacent the sprinkling of said melted iron sulfide-rich sulfide concentrate, and spaced from the discharge of said slag, said reductant material being a metallic iron-rich material containing at least one of the elements selected from carbon and silicon.

13. In the method of producing a metal matte as defined in claim 12, the improvement wherein said nonferrous metal is selected from the group comprising copper, nickel, cobalt, or mixtures thereof.

14. In the method for producing a metal matte as defined in claims 12 or 13, the improvement wherein said sulfide concentrate and oxygen-rich gas is sprinkled into said enclosed hot sulfur dioxide-rich atmosphere, a major portion of said sulfide concentrate and oxygen-rich gas being injected as a mixture through a plurality of vertically disposed burners on said furnace into said enclosed sulfur dioxide-rich hot atmosphere as a plurality of paraboloidal suspensions, so as to effect substantially uniform heat and mass distribution over a major portion of said horizontal furnace.

15. In the method for producing a metal matte as defined in claim 12, the improvement wherein said metallic iron-rich material is selected from pig iron, silvery pig iron, ferro-silicon, sponge iron and scrap iron.

16. In the method for producing a metal matte as defined in claim 12, the improvement wherein said nonferrous metal-containing sulfide mineral concentrate is a nickel and cobalt sulfide mineral concentrate rich in nickel, and wherein the metal matte produced contains more than 50% combined nickel and cobalt by weight, representing more than 98% of the nickel and more than 80% of the cobalt in the concentrate fed to the furnace, by weight, and the exhaust gas from the furnace contains more than 20% sulfur dioxide by volume, representing more than 75% of the sulfur in the combined sulfide concentrates fed to the furnace, by weight.

17. In the method for producing a metal matte as defined in claim 12, the improvement wherein said nonferrous metal-containing sulfide mineral concentrate is a copper, cobalt, nickel sulfide mineral concentrate, rich in copper and cobalt, and wherein the metal matte produced contains more than 50% combined copper and cobalt by weight, representing more than 98% of the copper and more than 80% of the cobalt in the concentrate fed to the furnace, by weight, and the exhaust gas from the furnace contains more than 20% sulfur dioxide by volume, representing more than 75% of the sulfur in the combined sulfide concentrates fed to the furnace, by weight.

18. In the method for producing a metal matte as defined in claim 12, the improvement wherein said nonferrous metal-containing sulfide mineral concentrate is a copper sulfide mineral concentrate containing minor but important quantities of arsenic, bismuth, cadmium, lead, molybdenum, and zinc, and wherein the metal matte produced contains more than 50% copper by weight, representing more than 98% of the copper in the concentrate fed to the furnace, by weight, and the exhaust gas from the furnace contains more than 20% sulfur dioxide by volume and more than 75% of said arsenic, bismuth, cadmium, lead, molybdenum, sulfur, and zinc in the combined sulfide concentrates fed to the furnace, by weight.

19. In the method for producing a metal matte as defined in claim 12, the improvement wherein said nonferrous metal-containing sulfide concentrate contains at least one nonferrous metal selected from the group consisting of copper and nickel, and minor but important quantities of at least one of the minor elements selected from the group consisting of antimony, arsenic, bismuth, cadmium, germanium, indium, lead, mercury, molybdenum, osmium, rhenium, selenium, tellurium, tin and zinc, and wherein the metal matte produced contains more than 50% by weight of said nonferrous metal of the group above defined, representing more than 98% of said nonferrous metal in the concentrate fed to the furnace, by weight, and the exhaust gas from the furnace contains more than 20% sulfur dioxide by volume and a major portion of said at least one minor element, said sulfur dioxide in the exhaust gas representing a major portion of the sulfur, in the combined sulfide concentrates fed to the furnace, by weight.

20. In a method for producing a metal matte from a nonferrous metal-containing sulfide mineral concentrate of a particle size of less than about 65 mesh and containing particles of a size less than about 5 microns, in a horizontally disposed furnace wherein a molten charge of metal matte and a slag are present, beneath an enclosed hot atmosphere, and exhaust gases, metal matte and slag are separately discharged therefrom, the improvement wherein loss of nonferrous metals is averted, comprising:

(a) separating from said nonferrous metal-containing sulfide mineral concentrate particles thereof having a size less than about 5 microns from the remainder of said sulfide concentrate;

(b) compacting said separated concentrate particles to form compacted concentrates for introduction into said furnace and onto said slag;

(c) introducing the remainder of said sulfide concentrate, flux and oxygen-rich gas into an enclosed hot sulfur dioxide-rich atmosphere so as to effect flash oxidation of the sulfide concentrates therein prior to contact of said concentrates with the molten slag, while injecting said compacted concentrate into the horizontal furnace and onto said slag at a location spaced from the slag discharge of the furnace;

(d) sprinkling a melted iron sulfide-rich sulfide concentrate into the furnace by means of a burner, using fossil fuel and oxygen-rich gas as the main heat source therefor to spread the same onto the slag, at a location adjacent and downstream from the introduction of said compacted concentrate and spaced from the discharge of said slag; and (e) injecting a reductant material into the furnace, for spreading over the slag, at a location adjacent the sprinkling of said melted iron sulfide-rich sulfide concentrate and spaced from the discharge of said slag, said reductant material being a metallic iron-rich material containing at least one of the elements selected from carbon and silicon.

21. In the method for producing a metal matte as defined in claim 20, the improvement wherein said nonferrous metal is selected from the group comprising copper, nickel, or mixtures thereof.

22. In the method for producing a metal matte as defined in claims 20 and 21, the improvement wherein said sulfide concentrate and oxygen-rich gas is sprinkled into said enclosed hot sulfur dioxide-rich atmosphere, a major portion of said sulfide concentrate and oxygen-rich gas being injected as a mixture through a plurality of vertically disposed burners on said furnace into said enclosed sulfur dioxide-rich hot atmosphere as a plurality of paraboloidal suspensions, so as to effect substantially uniform heat and mass distribution over a major portion of said horizontal furnace.

23. In the method for producing a metal matte as defined in claim 22, the improvement wherein said metal matte and slag flow countercurrently in said furnace.

24. In the method for producing a metal matte as defined in claim 22, the improvement wherein said reductant material is sponge iron.

25. In a method for producing metal matte from a nonferrous metal-containing sulfide mineral concentrate in a horizontally disposed furnace wherein a molten charge of metal matte and a slag are present, beneath an enclosed hot atmosphere, and exhaust gases, metal matte, and slag are separately discharged therefrom, the improvement wherein loss of non-ferrous metals is averted comprising:

(a) introducing a sulfide concentrate containing at least one nonferrous metal selected from the group consisting of copper, nickel and cobalt, and minor but important quantities of minor elements selected from the group consisting of antimony, arsenic, bismuth, cadmium, germanium, mercury, molybdenum, rheniun, tin and zinc; flux and an oxygen-rich gas into an enclosed hot sulfur dioxide-rich atmosphere so as to effect flash oxidation of said sulfide concentrate therein prior to contact of said concentrate with the molten slag, a major portion of said sulfide concentrate and oxygen-rich gas being injected as a mixture through a plurality of vertically disposed burners on said furnace into said enclosed sulfur dioxide-rich hot atmosphere as a plurality of paraboloidal suspensions;

(b) producing a metal matte containing more than 50% by weight of said nonferrous metal of the group above defined; and (c) exhausting gas from the furnace which contains more than 20% sulfur dioxide by volume and a major portion of said minor elements.

26. In a method for producing a metal matte as defined in claim 29 the improvement wherein the major nonferrous metal is copper.

27. In a method for producing a metal matte as defined in claim 29, the improvement wherein the major nonferrous metal is nickel.

* * * * *